United States Patent [19]

Radford et al.

[11] Patent Number: 4,552,229

[45] Date of Patent: Nov. 12, 1985

[54] EXTERNALLY POWERED CORE CATCHER

[75] Inventors: Steven R. Radford, West Jordan; Craig R. Hyland, Magna, both of Utah

[73] Assignee: Norton Christensen, Inc., Salt Lake City, Utah

[21] Appl. No.: 530,520

[22] Filed: Sep. 9, 1983

[51] Int. Cl.[4] ..... E21B 25/12

[52] U.S. Cl. ..... 175/240; 175/250; 175/251; 175/253; 175/255

[58] Field of Search ..... 175/240, 239, 241, 243, 175/244, 245, 233, 249, 250, 253, 254, 255, 251

[56] References Cited

U.S. PATENT DOCUMENTS

| | | | |
|---|---|---|---|
| 2,238,609 | 4/1941 | Sewell | 175/245 |
| 2,347,726 | 5/1944 | Auld et al. | 175/233 |
| 3,409,094 | 11/1968 | Kretschmer et al. | 175/254 |
| 4,258,803 | 3/1981 | Thompson et al. | 175/240 |

FOREIGN PATENT DOCUMENTS

| | | | |
|---|---|---|---|
| 0612003 | 6/1978 | U.S.S.R. | 175/255 |

OTHER PUBLICATIONS

"Improved Barrel and Bit Increases Core Recovery", by Burrows, Nov. 1946.

*Primary Examiner*—James A. Leppink
*Assistant Examiner*—Hoang C. Dang
*Attorney, Agent, or Firm*—Beehler, Pavitt, Siegemund, Jagger & Martella

[57] ABSTRACT

A mechanism for catching and holding a core within an inner tube in a drill string includes a slidable core catcher and a full closure core catcher. The slidable core catcher is disposed within the inner tube and is coupled to an inner tube ring concentrically mounted on the outside of the inner tube. The inner tube ring and the slidable core catcher are connected to each other by means of a shear pin slidable within a slot defined in the inner tube. An outer tube ring is connected to the outer tube concentrically disposed about the inner tube. When the outer tube ring contacts the inner tube ring as the inner tube is lifted, the inner tube ring is moved downwardly with respect to the inner tube, thereby pulling the core catcher with it. As the core catcher moves downwardly it is compressed by an inside conical surface provided near the end of the inner tube. This serves to effectuate operation of the slideable core catcher. As the slidable core catcher is moved downwardly its upper edge will clear the lower surfaces of a spring loaded full closure catcher which is formed in the shape of a cusped flapper valve. Thus, when the slidable core catcher has been longitudinally displaced with respect to the inner tube by a predetermined distance the full closure catcher will, in the case of an unconsolidated core, close completely and thereby retain the unconsolidated core within the inner tube.

18 Claims, 5 Drawing Figures

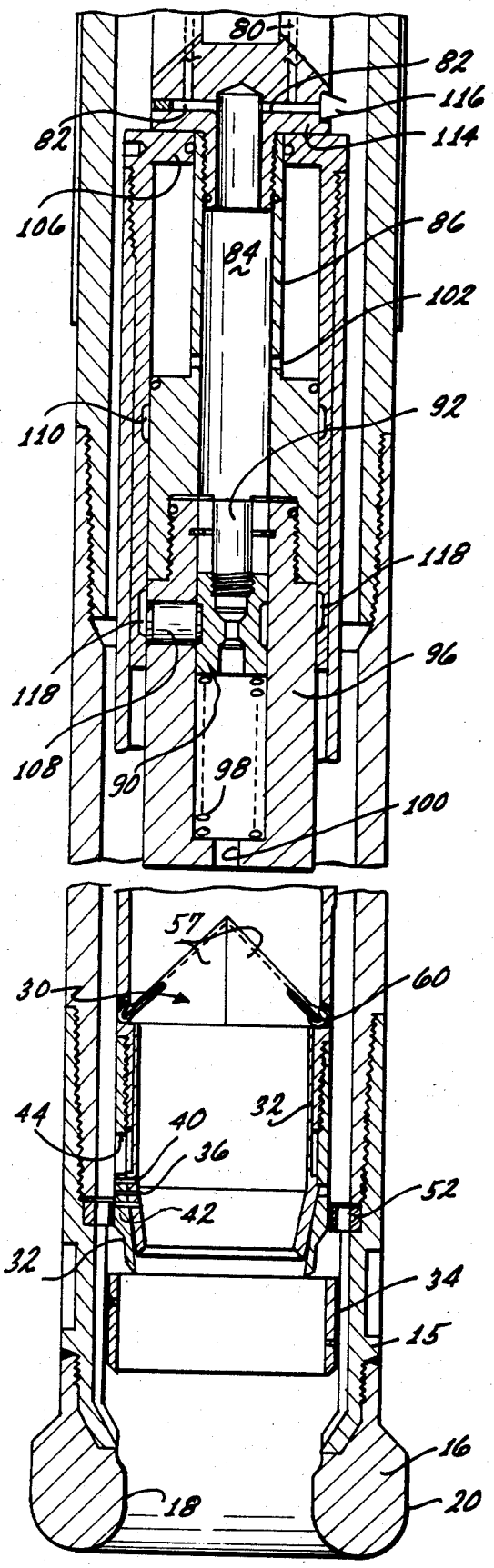
Fig.4
Fig.5
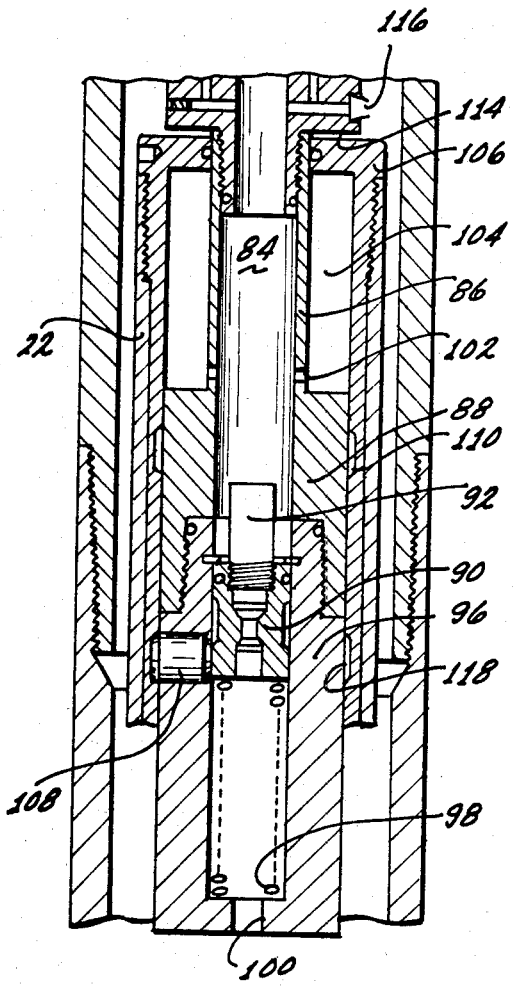

EXTERNALLY POWERED CORE CATCHER

BACKGROUND OF THE INVENTION

1. Field of the Invention

The present invention relates to the field of earth boring tools and in particular to core catchers used for retaining cores cut during coring operations.

2. Description of the Prior Art

Coring is a common practice in the field of petroleum exploration, and it is not uncommon to encounter formations which are considered impossible to core because of their unconsolidated nature. For example, oil-sand, water-sand or loose debris constitute types of formations found in the field which extremely difficult to core.

Even if the loose, unconsolidated material can be successfully cored or cut, the problem still remains as to how to remove this material from the bore hole in a manner such that its original orientation is undisturbed. Alternatively, the problem may simply be how to remove the core at all. Typically, in prior art coring operations using conventional core catchers, such unconsolidated material will drop out of the core barrel as the core barrel is lifted to the surface of the hole.

What is needed then is some means whereby unconsolidated and loose material can be permitted to enter the core barrel but is prohibited from exiting, particularly when the barrel is lifted to the surface of the hole. Such a design should be able to operate successfully even when the formation is so soft and unconsolidated that the core must enter the barrel in an substantially unrestricted manner if its original orientation is to be preserved. In other words, what is needed is a coring system design that will not contact the core as it enters the barrel in any way, but will be able to completely retain the core when the barrel is lifted.

BRIEF SUMMARY OF THE INVENTION

The present invention is an apparatus which is used in combination with a coring bit which in turn is connected to an outer tube of a drill string. The apparatus is used for retention of the core which is cut by the coring bit and which is disposed within the inner tube concentrically disposed in turn within the outer tube of the drill string. The apparatus comprises a slidable core catcher disposed within the inner tube and longitudinally displaceable with respect to the inner tube. An inner tube ring member is coupled to the slidable core catcher and is selectively detachable therefrom. The inner tube ring member is longitudinally translatable with respect to the outer tube. An outer tube ring member is coupled to the outer tube and is longitudinally fixed thereto. The outer tube ring member extends radially inward from the outer tube to assume a longitudinal position opposing the inner tube ring member when the inner tube ring member is adjacently disposed to the outer tube ring member. Longitudinal movement of the inner tube with respect to the outer tube causes longitudinal displacement of the slidable core catcher within the inner tube by virtue of the coupling between the inner tube ring member and the core catcher when longitudinal movement of the inner tube ring member is restrained by contact with the outer tube ring member. The inner tube ring member is particularly characterized by selectively detaching from the slidable core catcher after a predetermined amount of longitudinal displacement relative to the inner tube. By this combination of elements, a slidable core catcher is operative by an externally powered force which can be applied to the inner tube and the core catcher's operation is not dependent upon contact or coupling with the core which is disposed through the core catcher.

BRIEF DESCRIPTION OF THE DRAWINGS

FIG. 4 is a cross-sectional view of the drill string of FIG. 2 at a third stage of operation.

FIG. 5 is a cross-sectional view in enlarged scale of a portion of the drill string of FIG. 2 in its final stage of operation.

The present invention including its mode and manner of operation is better understood by considering the above Figures in light of the following detailed description.

DETAILED DESCRIPTION OF THE PREFERRED EMBODIMENTS

The invention is an externally powered core catcher capable of capturing cut cores in unconsolidated and loose formations in a manner such that the core, when cut, is undisturbed. The externally powered core catcher includes a modified conventional core catcher which is slidable within the end portion of the core barrel according to means described in greater detail below. The slidable, conventional core catcher is externally actuated to grip and seize a core which is fully disposed within the core barrel. However, activation of the core catcher is, as stated, external and is not dependent upon any type of co-action with the core. In the case of an unconsolidated core, such a conventional core catcher, even when externally activated, may often fail to prevent loss of the unconsolidated core from the barrel. Therefore, also according to the invention, the slidable core catcher co-acts with a biased, full-closure core catcher which acts as a check valve to completely close off and seal the core barrel in the case of soft or unconsolidated formations. The manner in which the slidable core catcher is externally powered and its co-action with the full closure core catcher can be better understood by now turning to consider in detail the illustrated embodiment.

Figure 1:
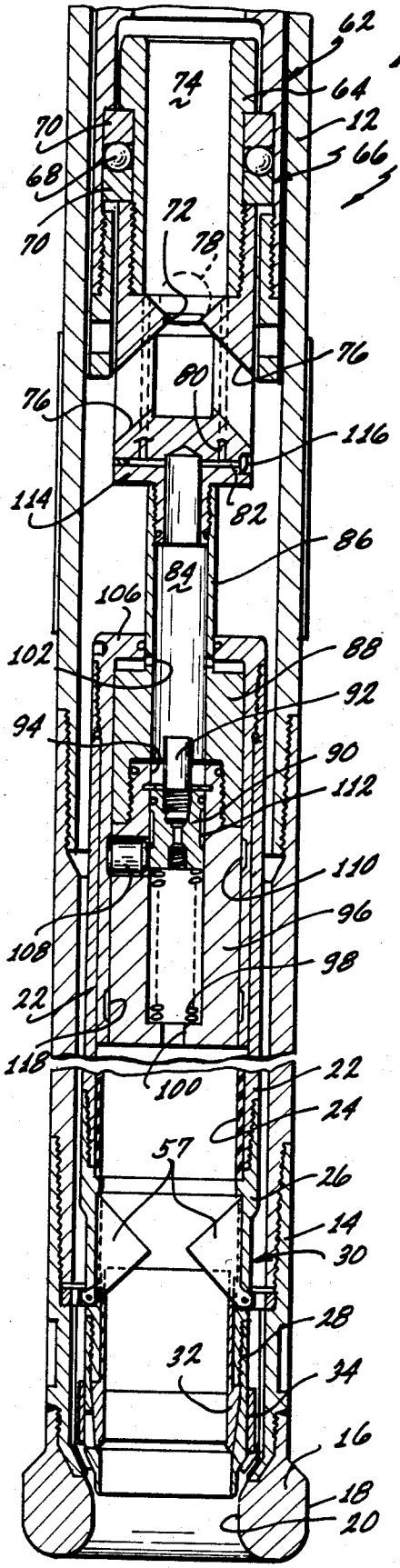
FIG. 1 is a longitudinal sectional view of a drill string used in a coring operation which incorporates the invention.

Turn now to FIG. 1 which is a broken cross-sectional view of a portion of a drill string as used in coring operations, which drill string incorporates the invention. The drill string, generally denoted by reference numeral 10, includes an outer tube 12, which in turn may include a plurality of threadably coupled subsections or outer tube subs. Outer tube 12 is threadably coupled in a conventional manner to a coring bit 14. Coring bit 14 in turn includes a bit crown 16 which provides the operative cutting action when rotated. In the present embodiment, a rotating diamond bit is shown, although the invention is not limited to just diamond rotating bits. Any coring bit could be used in combination with the invention. Bit crown 16 defines the inner diameter of the bore hole by the diameter of outer gage 18, and defines the outer diameter of the core by inner gage 20. For the sake of clarity, the bore hole and the core have been omitted so that the elements of the invention can be more clearly depicted. However, bit crown 16 will cut a core in conventional manner which will be fed upwardly within an inner tube 22. In the illustrated embodiment inner tube 22 is also provided with a plastic liner 24 at its lower end which liner 24 is removable with the core for ease of handling. When the core is retrieved to the surface of the hole, plastic liner 24 is removed from inner tube 22, capped at each end or cut into sections and capped for transportation to a petroleum laboratory for testing.

As illustrated in each of the Figures, inner tube 22 is threadably connected at its lower end to an upper inner tube shoe 26. Inner tube shoe 26 in turn is threadably coupled to a bottom inner tube shoe 28. A full closure core catcher, described in greater detail below and generally denoted by reference numeral 30 and a slidable core catcher 32 are disposed within inner tube shoe 26 and bottom inner tube shoe 28.

Figure 2:
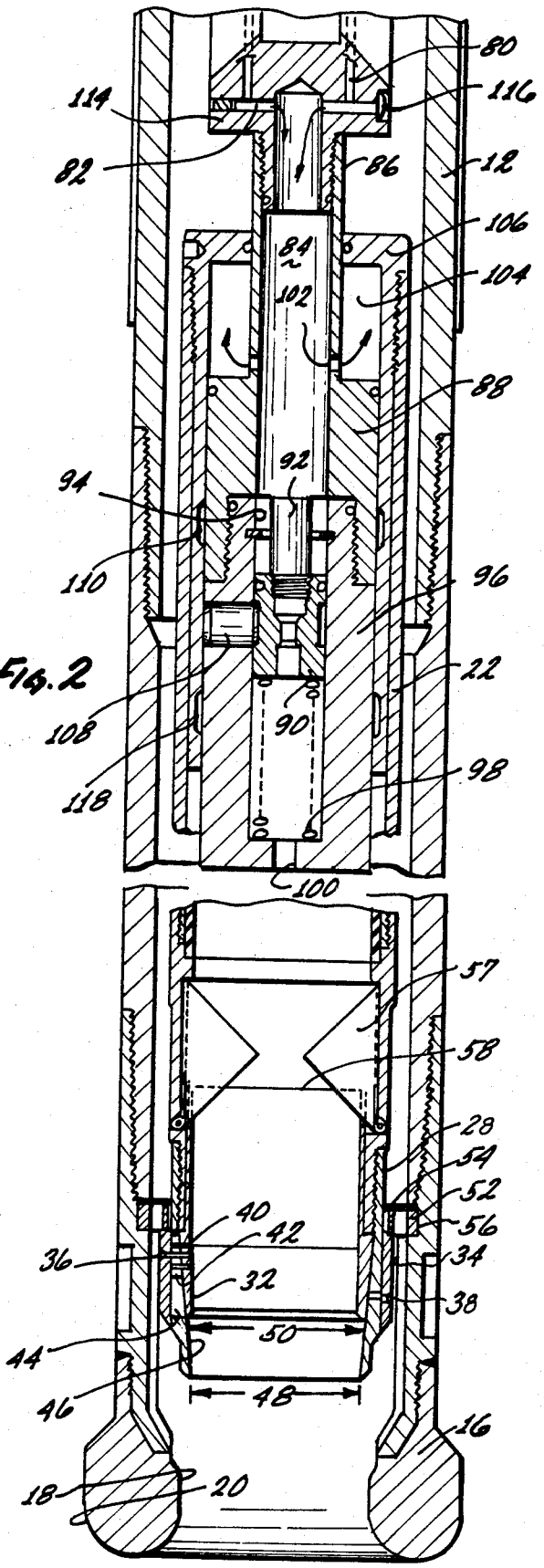
FIG. 2 is a cross-sectional view in enlarged scale of a portion of the drill string of FIG. 1 at a first stage of operation of the core catcher.

Consider first slidable core catcher 32. Slidable core catcher 32 is substantially similar to a conventional core catcher with the exception that slidable core catcher 32 is longitudinally translatable within inner tube shoe 26 and bottom inner tube shoe 28 in a direction parallel to the longitudinal axis of shoes 26 and 28 or equivalently inner tube 22. As shown in FIG. 2 slidable core catcher 32 is pinned to inner tube shoe ring 34 by means of second set of shear pins 36. A first set of shear pins 38, diametrically opposed to second shear pins 36 serves to connect inner tube shoe ring 34 to bottom inner tube shoe 28. Shear pins 36 and 38 are best seen in FIGS. 2–5. Slidable core catcher 32 is also connected by means of bolts 40 to shoe slip 42. Shoe slip 42 is longitudinally slidable within a longitudinal slot 44 defined through bottom inner tube shoe 28. Thus, slidable core catcher 32 may move longitudinally relative to bottom inner tube shoe 28 by virtue of the longitudinal displacement of shoe slip 42 within slot 44 defined through bottom inner tube shoe 28 after ring 34 is released from tube shoe 28.

As illustrated in each of the Figures, bottom inner tube shoe 28 includes a conical inner surface 46 characterized by a first diameter 48 at its lower end, nearest bit crown 16, and a second larger diameter 50 at the end of the bore formed within inner tube shoe 28 at a point longitudinally displaced away from bit crown 16. Therefore, as slidable core catcher 32 moves longitudinally with respect to inner tube shoe 28, as will be described in greater detail below, slidable core catcher 32 will be squeezed by the smaller diameter of conical surface 46 of inner tube shoe 28 thereby causing core catcher 32 to compress and to grip the core which has been cut and fed upwardly into inner tube 22. In the case where the core is hard, slidable core catcher 32 will thus operate in a conventional manner to grip and catch the core within inner tube 22.

Consider now the means by which slidable core catcher 32 is longitudinally displaced with respect to inner tube shoe 28. When the core barrel is lifted from the well hole, inner tube 22 will be longitudinally polled upwardly by means described in greater detail below. At first, inner tube shoe ring 34 is rigidly connected by first shear pin 38 to inner tube shoe 28 and therefore the entire assembly, including core catcher 32, moves upwardly with inner tube 22 while outer tube 12, including bit crown 16, remains longitudinally stationary.

Turn now to FIG. 2 which illustrates a situation wherein inner tube 22 has been lifted by a predetermined distance sufficient to bring the top surface of inner tube shoe ring 34 against an outer tube ring 52. Outer tube ring 52, which may include a plurality of hydraulic bypass ports 54 defined therethrough, is longitudinally fixed to outer tube 12. In particular, outer tube ring 52 is set within a counterbore 56 defined within coring bit 16 and is wedged in place by the butt end 58 of the lowermost section of outer tube 12.

When, as in FIG. 2, inner tube shoe ring 34 contacts outer tube ring 52, a transverse stress is applied to first shear pin 38 by the force urging inner tube 22 upwardly. First shear pin 38 is designed to shear at a predetermined transverse stress. When first shear pin 38 fails, inner tube shoe ring 34 is disconnected from inner tube shoe 28. As inner tube 22 and ultimately inner tube shoe 28 continue to be pulled upwardly, inner tube shoe ring 34 is retained in its relative longitudinal position with respect to outer tube 12 by outer tube ring 52. Inner tube shoe ring 34 thus pulls slidable core catcher 32 downwardly within slot 44 as inner tube 22 continues its upward movement. As described, the downward motion of core catcher 32 within conical surface 46 of inner tube shoe 28 will cause core catcher 32 to grasp the core.

Ultimately, inner tube 22 will have moved upwardly by an amount equal to the longitudinal distance of slot 44 and shoe slip 42 will thus be at the bottom of slot 44. This configuration is illustrated by the cross-secctional view of FIG. 3. As is clearly evident in FIG. 3, inner tube shoe ring 34, has during the entire operation and continuing to the situation depicted in FIG. 3, remained in contact with outer tube ring 52. As inner tube 22 continues to be urged upwardly, a transverse stress will then be applied to second shear pin 36. Again at a predetermined magnitude of stress, second shear pin 36 will fail thereby decoupling core catcher 32 from inner tube shoe ring 34. Inner tube 22 including core catcher 32 which is now tightly jammed near or in diameter 48 of inner tube shoe 28 are then freed for continued upward movement of inner tube 22.

Figure 3:
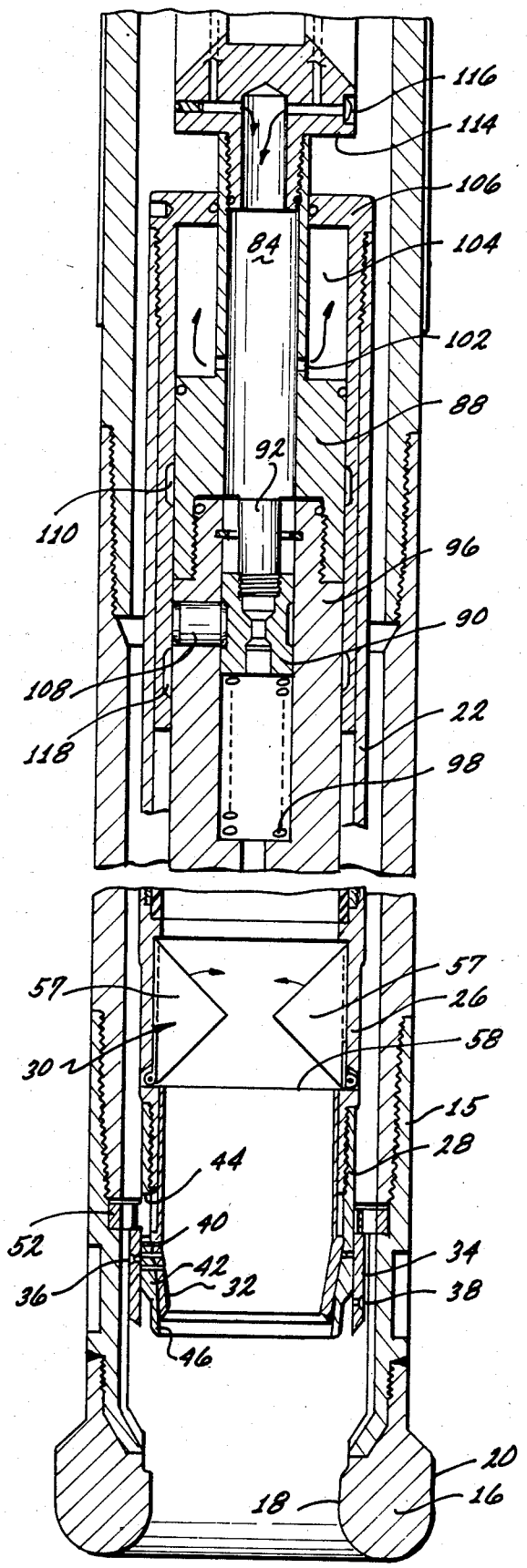
FIG. 3 is a cross-sectional view of the drill string of FIG. 2 at a second stage of operation of the core catcher.

However, as depicted in FIG. 3, when core catcher 32 has reached the bottom of slot 44, the opposing end 58 of core catcher 32 has just cleared the bottom edge of full closure core catcher 30. Full closure core catcher 30 is divided into a plurality of segments 57, two of which are shown in elevational view in the Figures. The segments of full closure core catcher 30 form a cusp-shaped check valve which is closable across the inner diameter of inner tube 22. Segments 57 of full closure core catcher 30 may be cut, cast or forged to approximate the inner diameter of inner tube shoe 26. Each segment 57 includes a hinge 60 at the lower end of segment 57, which hinge 60 is connected to inner tube shoe 26 and provides an axis of rotation for the corresponding segment, which axis is substantially tangential to the inner surface of inner tube shoe 26. Thus, each segment 57, is able to rotate about its coresponding hinge 60 toward the center of inner tube shoe 26 to there mate with a corresponding opposing segment or segments 57 to form a full closure cusped check-valve. In the illustrated embodiment of two to four segments 57 are used to provide a complete closure of inner tube shoe 26. Segments 57, when closed, remain at an angle with respect to the longitudinal axis of the drill string and of inner tube shoe 26. Again, in the illustrated embodiment, when in the closed configuration, segments 57 form a conically shaped closed surface having a cone angle of 30° to 45° with respect to the longitudinal axis of inner tube shoe 26.

Turning to FIG. 3, it should be particularly noted that full closure core catcher 30 cannot close until slidable core catcher 32 has been longitudinally displaced by a sufficient distance so that end 58 clears the lowermost portion of full closure core catcher 30. In the illustrated embodiment, each hinge 60 is provided with a torsion spring which tends to urge its corresponding segment 57 inwardly into the fully closed position. In addition, any downward movement of the core within inner tube shoe 26 will cause the inclined segments of full closure core catcher 30 to dig into the core and rotate to the closed position. Clearly, in the case where a hard core is taken, full closure core catcher 30 will not be able to rotate inwardly, nor serve to catch the core within inner tube 22. However, in the case of hard cores, slidable core catcher 32 is adequate to catch the core within the barrel. In the case of soft and unconsolidated cores, slidable core catcher 32 cannot obtain a grip or bite on the core which would simply fall through core catcher 32. In that case, when core catcher 32 has moved downwardly as shown in FIG. 3, full closure core catcher 30 will be activated by the biased spring at each hinge 60 and full closure core catcher 30 will close into the soft formation and completely seal inner tube 36 and retain all core material lying above catcher 30 within inner tube 22. Any downward movement of the soft core only tends to seal and close full closure core catcher 30 more tightly.

At this point, the core is retained within inner tube 22 either by core catcher 32, full closure core catcher 30, or both, and the entire drill string can then be removed from the bore hole, disassembled, and the cut core retrieved. Throughout the above discussion it has been assumed that there is some means which pulls inner tube 22 upwardly to activate the sequence of operations described. A number of means may be employed for longitudinally displacing inner tube 22, and inner tube shoes 26 and 28 by a sufficient distance and with sufficient force to effect the operation disclosed. However, in the preferred embodiment, inner tube 22 is activated by a hydraulic lift described below and claimed in the copending application entitled A Hydraulic Lift Inner Barrel in a Drill String Ser. No. 530,492, filed Sept. 9, 1983, assigned to the same assignee of the present application.

Turn again to FIG. 1 and in particular note the upper portion of the drill string illustrated therein. Beginning at the top, outer tube 12 is connected in a conventional manner to a conventional bearing assembly 62. The connection between bearing assembly 62 and outer tube 12 has been omitted for the sake of clarity in FIG. 1. As is well known in the art, bearing assembly 62 is simply threadably connected to or splined to an inside mating surface (not shown) provided in outer tube 12.

The upper portion of bearing assembly 62 is rotatably coupled to bearing retainer 64 which is axially disposed within bearing assembly 62. Coupling of bearing retainer 64 with bearing assembly 62 is by means of a conventional ball bearing thrust bearing, generally denoted by reference numeral 66. Thrust bearing 66 includes ball bearings 68 carried in an upper and lower raceway 70.

Bearing retainer 64 includes a port 72 defined within its lower portion. Port 72 provides the primary means by which hydraulic fluid flows through outer tube 12 into a chamber 74 axially defined within the upper portion of bearing retainer 64. Hydraulic fluid or drilling mud flows through port 72 and out of bearing retainer 64 through primary radial ports 76. The hydraulic fluid continues to flow downwardly within outer tube 12, and outside of inner tube 22 to inner gage 20 of core bit 15.

However, when it is desired to longitudinally displace inner tube 22 with respect to outer tube 12 in the manner as described above, a solid check ball 78 is dropped into the hydraulic flow flowing downwardly within the drill string. Ball 78 ultimately comes to rest within port 72 in the manner depicted in FIG. 1. Check ball 78, is of sufficient diameter that it effectively closes and jams into port 72 of bearing retainer 64. Hydraulic fluid can thus no longer pass through its primary path through port 72 and radial ports 76. Instead, hydraulic fluid is now forced through longitudinal passages 80 defined within bearing retainer 64. Longitudinal passages 80 communicate with transverse passage 82. Hydraulic fluid is thus forced through transverse passage 82 into axial chamber 84 defined within the longitudinal extension 86 of an inner mandrel 88.

Pressure then begins to build up within axial chamber 84 against the top surface of inner locking piston 90. Inner locking piston 90 includes a check valve 92 axially disposed therethrough. However, check valve 92 is a one way valve which only permits upward flow of hydraulic fluid. Inner locking piston 90 is, as illustrated in the Figures, disposed within an axial chamber 94 defined within a bottom end inner mandrel 96 which, in turn, is threadably coupled to top end inner mandrel 88. Axial chamber 94 is concentric with axial chamber 84 within top end inner mandrel 88. Inner locking piston 90 is biased within chamber 94 by a compression spring 98 bearing at one end against the bottom end of inner locking piston 90 and bearing at its other end against the termination of axial chamber 94 defined within bottom end inner mandrel 96. Axial chamber 94 is communicated with the interior of inner tube 22 by means of a venting port 100 which allows the pressure behind inner locking piston 90 to always be relieved.

Meanwhile, after check ball 78 has seated, pressure continues to build on the top of inner locking piston 90 thereby compressing piston 90 against spring 98 and driving piston 90 downwardly within axial chamber 94. However, at the same time, hydraulic pressures is provided through radial ports 102 defined through longitudinal tube 86 into an innerlying space 104 between the top surface of top end inner mandrel 88 and an outer piston 106. Outer piston 106 is, however, connected through movable locking dog 108 to the upper end of inner mandrel 96. Therefore, outer piston 106 cannot move relative to mandrel 88 or 96 as long as it is locked by locking dog 108, but applies an upward force against locking dog 108. The circumferential edges of locking dog 108 are chamfered as are the edges of indentations 110 radially defined into the inner surface of outer piston 106. The engagement of locking dog 108 into the mating indentation 110 is in fact the means by which outer piston 106 is locked with respect to bottom end inner mandrel 96.

However, when sufficient pressure has been created to move piston 90 against spring 98 by distance sufficient to align mating indentation 12, radially defined within inner piston 90, with locking dog 108, dog 108 will be forced out of indentation 110 of outer piston 106 and into indentation 112 defined in inner piston 90. At this point, outer piston 106 is free to move upwardly with respect to bottom end inner mandrel 96 and top end inner mandrel 88.

As outer piston 106 begins to move longitudinally upward as shown in FIGS. 2 and 3, it carries inner tube 22 with it, which is threadably connected to it. The upward longitudinal motion of outer piston 106, carrying inner tube 22, is the lifting force which activiates full closure catcher 30 and slidable core catcher 32 in the manner described above.

Outer piston 106 continues to move upwardly until it reaches the configuration illustrated in FIG. 4. At that point outer piston 106 is restrained from further longitudinal movement by a juxtapositioned bottom shoulder 114 of bearing retainer 64. Hydraulic pressure, which has been moderated by the expansion of outer piston 106 now begins to increase again. At a predetermined pressure, a burst disk 116 disposed in the outer radial end of one of the transverse passages 82 will fail as indicated in FIG. 4. Therefore, hydraulic fluid being supplied through longitudinal passages 80 to transverse passage 82 will be vented through the radial opening, previously sealed by disk 116, and will be emptied into the low pressure interior of outer tube 12.

At this time the hydraulic pressure within axial chamber 84 and 94 begins to decrease. As shown in FIG. 4, outer piston 106 is also provided with a radial indentation 118 at its lower end which is also adapted to mate with the corresponding outer radial surface of locking dog 108. However, when outer piston 106 has reached its full expansion and is in contact with shoulder 114 of bearing retainer 64, indentations 118 will have moved upwardly and past locking dog 108 by approximately one-quarter of an inch. When the pressure begins to decrease by the bursting of disk 116, outer piston 106 will begin to fall downwardly under the action of its own weight. However, at the same time, piston 90 is urged upwardly by spring 98 and indentation 112 within piston 90 begins to urge locking dog 108 radially outward. However, because of the misalignment between locking dog 108 and indentation 118 when in the configuration shown as FIGS. 3 and 4, locking dog 108 is unable to move radially outward.

However, as the pressure decreases, outer piston 106 will begin to move downwardly under its own weight. After it has moved downwardly by approximately one-quarter of an inch, locking dog 108 will be forced outwardly into indentations 118, which are now aligned, thereby allowing piston 90 under the urging of spring 98 to move to the fully extended position as shown in FIG. 5. Once again, outer piston 106 is longitudinally locked with respect to bottom end inner mandrel 96. This mutual locking between mandrel 96 and piston 106, of course, means that inner tube 22, which is connected to outer piston 106 is longitudinally fixed with respect to outer tube 12. Outer tube 12 is ultimately connected through bearing 62, 64, longitudinal tube 86 and top end inner mandrel 88 to bottom end inner mandrel 96. Therefore, the operative closure of core catcher 32 and full closure core catcher 30 are maintained in a locked position even after all hydraulic pressure has been removed.

Many modifications and alterations may be made by those having ordinary skill in the art without departing from the spirit and scope of the invention. For example, returning to the disclosed configuration of full closure core catcher 30, catcher 30 has been shown in the illustrated embodiment as rotatably connected to inner tube shoe 26. However, it is entirely within the scope of the present invention that full closure core catcher 30 could be positioned elsewhere within the drill string, such as within the core bit shank and need not run on inner tube shoe 26. In this configuration, inner tube shoe 28 would be lifted upwardly in the same manner as before and after the lower end of inner tube shoe 28 had cleared the upper end of the full closure core catcher mounted in the coring bit shank, the full closure core catcher would then be free to close in substantially the same manner as described above in the illustrated embodiment.

Therefore, the illustrated embodiment must be understood as being described only for the purposes of clarity and example. It is not intended that the illustrated embodiment serve as a limitation of the invention which is defined in the following claims.

We claim:

1. An apparatus used in combination with a coring bit connected to an outer tube for retention of a core, said core being cut by said coring bit and disposed within an inner tube disposed in turn within said outer tube, an external force being selectively applied to said inner tube, said apparatus comprising:

a slidable core catcher disposed within said inner tube and longitudinally displaceable with respect to said inner tube, said core being disposed through said core catcher;

an inner tube ring member coupled to said slidable core catcher and selectably detachable therefrom, said inner tube ring member longitudinally translatable with respect to said outer tube; and an outer tube ring member coupled to said outer tube and longitudinally fixed thereto, said outer tube ring member extending radially inwardly from said outer tube to assume a longitudinal position opposing said inner tube ring member when said inner tube ring member is adjacently disposed to said outer tube ring member, longitudinal movement of said inner tube with respect to said outer tube thereby causing longitudinal displacement of said slidable core catcher within said inner tube by virtue of said coupling between said inner tube ring member and core catcher when longitudinal movement of said inner tube ring member is restrained by said outer tube ring member, said inner tube ring member being particularly characterized by selectively detaching from said slidable core catcher after a predetermined amount of relative longitudinal displacement between said inner tube and said slidable core catcher, whereby said slidable core catcher is operative by said external force applied to said inner tube and not dependent upon contact and coupling with said core disposed through said core catcher into said inner tube.

2. The apparatus of claim 1 further comprising a full closure core catcher including a plurality of closable segements to effect a complete closure of said inner tube, said full closure core catcher being concentrically disposed within said inner tube with said slidable core catcher and maintained in an open configuration by an initial relative position of said slidable core catcher, said slidable core catcher being removed from concentric juxtaposition with said full closure core catcher after said slidable core catcher has been longitudinally displaced through said predetermined distance, thereby allowing said full closure core catcher to assume a fully closed configuration.

3. The apparatus of claim 1 further comprising a full closure core catcher concentrically disposed with respect to said inner tube and operative to assume a fully closed configuration after a predetermined longitudinal displacement of said inner tube with respect to said outer tube.

4. The apparatus of claim 1 wherein said inner tube ring member is coupled to said inner tube and selectively detachable therefrom.

5. The apparatus of claim 4 wherein said inner tube ring member is selectively detachable from said slidable core catcher and said inner tube by virtue of said coupling between said inner tube ring member and slidable core catcher and between inner tube ring member and said inner tube by means of corresponding shear pins disposed therethrough, said shear pins in each case being sheared by means of a longitudinal force applied to each shear pin in a generally transverse direction arising from longitudinal displacement of said inner tube with respect to said outer tube ring member.

6. The apparatus of claim 5 wherein said shear pin coupling said inner tube ring member to said inner tube shears before said shear pin coupling said inner tube ring member with said slidable core catcher so that said inner tube ring member selectively detaches from said inner tube before said inner tube ring member selectively detaches from said core catcher.

7. The apparatus of claim 6 wherein said slidable core catcher is coupled to said inner tube ring member by said second shear pin and said second shear pin extends through a longitudinally oriented slot defined in said inner tube permitting unrestricted movement of said second shear pin and slidable core catcher attached thereto for a longitudinal distance less than or equal to the longitudinal length of said slot.

8. The apparatus of claim 1 wherein said inner tube ring member is coupled to said slidable core catcher by means of a shear pin, said shear pin extending through a longitudinally oriented slot defined in said inner tube, longitudinal movement of said inner tube with respect to said outer tube ring member forcing said slidable core catcher longitudinally downward with respect to said inner tube by virtue of blocking juxtaposition of said inner tube ring member against said outer tube ring member and as permitted by the predetermined longitudinal length of said slot defined in said inner tube.

9. The apparatus of claim 8 wherein said shear pin fails in a predetermined stress when said shear pin is disposed and restrained by the longitudinal limit of length of said slot after said inner tube has been longitudinally displaced with respect to said slidable core catcher by said corresponding predetermined longitudinal length, whereby said slidable core catcher is compressed by a corresponding conical inner surface of said inner tube.

10. The apparatus of claim 9 further comprising a full closure core catcher disposed within said inner tube, said slidable core catcher being at least partially concentrically disposed within said full closure core catcher, said full closure core catcher being concentrically disposed between said slidable core catcher and said inner tube, wherein relative displacement of said slidable core catcher with respect to said inner tube removes said slidable core catcher from concentric disposition with said full closure core catcher thereby allowing said full closure core catcher to assume a closed configuration within said inner tube.

11. The apparatus of claim 10 wherein said full closure core catcher is resiliently biased to assume a closed configuration within said inner tube.

12. An improvement in coring apparatus including a coring bit, outside tube and inner tube concentrically disposed within said outside tube, and including means for selectively longitudinally displacing said inner tube, said coring bit for cutting a core, said core being disposed within said inner tube, said improvement comprising:

a slidable core catcher means for seizing said core;

first means coupled to said slidable core catcher means for selectively longitudinally displacing said slidable core catcher means with respect to said inner tube without dependence on gravity or diametral fit of said slidable core catcher means with said core, said first means coupled to said inner tube and longitudinally displaced therewith;

second means for releasing said slidable core catcher means from said first means after said slidable core catcher has been longitudinally displaced with respect to said inner tube by a predetermined distance; and third means for activating said slidable core catcher means to cause said core catcher means to seize said core as said slidable core catcher means is longitudinally displaced through said predetermined distance.

13. The improvement of claim 12 further comprising a full closure core catcher means for retaining said core when said core is unconsolidated, said full closure core catcher means arranged and configured to be operatively activated after a predetermined relative longitudinal displacement of said slidable core catcher means with respect to said full closure core catcher means, said slidable core catcher means in an interference configuration with said full closure core catcher means so that displacement of said slidable core catcher means through said predetermined distance permits said full closure core catcher means to operate.

14. The improvement of claim 13 wherein said slidable core catcher means is slidingly coupled to said full closure core catcher means, said slidable core catcher means maintaining said full closure core catcher means in an open configuration until said means for longitudinally displacing said slidable core catcher means with respect to said inner tube has displaced said slidable core catcher means by a longitudinal distance sufficient to remove said slidable core catcher means from substantial sliding contact with said full closure core catcher means, said full closure core catcher means then being allowed to assume a fully closed configuration.

15. The improvement of claim 13 wherein said third means operates said slidable core catcher means without said core catcher means necessarily in contact with said core, said third means being operated by said first means for longitudinally displacing said slidable core catcher means with respect to said inner tube.

16. The improvement of claim 12 wherein said third means operates said slidable core catcher means without said core catcher means necesarily in contact with said core, said third means being operated by said first means.

17. An improvement in a coring apparatus including a coring bit, outside tube and inner tube concentrically disposed within said outside tube, said coring bit for cutting a core, said core being disposed within said inner tube, said improvement comprising:

a slidable core catcher;

first means coupled to said core catcher for longitudinally displacing said slidable core catcher with respect to said inner tube; and second means for releasing said slidable core catcher from said first means after said slidable core catcher has been longitudinally displaced by a predetermined distance, wherein said first means for longitudinally displacing said slidable core catcher with respect to said inner tube comprises an outer tube ring member coupled to said outer tube and longitudinally fixed thereto and radially extending within said outer tube toward said inner tube, said inner tube being slidable within said outer tube ring member, an inner tube ring member selectively coupled to said inner tube and selectively coupled to said slidable core catcher, said inner tube ring member arranged and configured to first contact said outer tube ring member thereby selectively decoupling said inner tube ring member from said inner tube after which said slidable core catcher is longitudinally displaced with respect to said inner tube by continued contact between said inner tube ring member and said outer tube ring member, said slidable core catcher then being selectively decoupled from said inner tube ring member after a predetermined amount of longitudinal displacement of said slidable core catcher with respect to said inner tube.

18. An improvement in a coring apparatus including a coring bit, outside tube and inner tube concentrically disposed within said outside tube, said coring bit for cutting a core, said core being disposed within said inner tube, said improvement comprising:

a slidable core catcher;

first means coupled to said core catcher for longitudinally displacing said slidable core catcher with respect to said inner tube;

second means for releasing said slidable core catcher from said first means after said slidable core catcher has been longitudinally displaced by a predetermined distance; and third means for operating said slidable core catcher to cause said core catcher to seize said core as said slidable core catcher is longitudinally displaced through said predetermined distance, wherein said third means comprises an inner conical surface formed within said inner tube, said slidable core catcher being disposed within said inner tube and displaced by said first means downwardly within said inner tube across said conical surface so that said conical surface compresses said core catcher and causes said core catcher to grip said core, said first means lifting said inner tube with respect to said outer tube and said slidable core catcher being selectively longitudinally fixed with respect to said outer tube as said inner tube is lifted by said first means.

* * * * *